US008335455B2

(12) United States Patent
Maeshima

(10) Patent No.: US 8,335,455 B2
(45) Date of Patent: Dec. 18, 2012

(54) TONER SUPPLYING DEVICE AND IMAGE FORMING APPARATUS

(75) Inventor: Masanobu Maeshima, Osaka (JP)

(73) Assignee: Kyocera Mita Corporation (JP)

( * ) Notice: Subject to any disclaimer, the term of this patent is extended or adjusted under 35 U.S.C. 154(b) by 491 days.

(21) Appl. No.: 12/642,986

(22) Filed: Dec. 21, 2009

(65) Prior Publication Data

US 2010/0166460 A1 Jul. 1, 2010

(30) Foreign Application Priority Data

Dec. 26, 2008 (JP) ..... 2008-335042
Nov. 27, 2009 (JP) ..... 2009-269560

(51) Int. Cl.
*G03G 15/08* (2006.01)

(52) U.S. Cl. ..... 399/120; 399/258; 399/262

(58) Field of Classification Search ..... 399/258, 399/262, 119, 120
See application file for complete search history.

(56) References Cited

U.S. PATENT DOCUMENTS 5,933,691 A 8/1999 Johroku

FOREIGN PATENT DOCUMENTS

JP 10-142915 5/1998
JP 2005-107141 A * 4/2005
JP 200684844 3/2006

* cited by examiner

*Primary Examiner* — Sophia S Chen
(74) *Attorney, Agent, or Firm* — Gerald E. Hespos; Michael J. Porco

(57) ABSTRACT

A toner supplying device is provided with a container body formed with a toner replenishment opening and adapted to contain toner, a shutter for opening and closing the toner replenishment opening, and an opening/closing structure for causing the shutter to perform opening and closing operations as the container body is mounted into and detached from the apparatus body. The opening/closing structure includes an arm projecting from the shutter in a mounting direction of the container body into the apparatus body and a locking portion attached to the arm. The locking portion includes a first locking claw engageable with and disengageable from a first engageable portion for locking formed at the guiding portion and a second locking claw engageable with and disengageable from a second engageable portion for locking formed at the container body.

15 Claims, 13 Drawing Sheets

TONER SUPPLYING DEVICE AND IMAGE FORMING APPARATUS

BACKGROUND OF THE INVENTION

1. Field of the Invention

The present invention relates to a toner supplying device to be detachably mounted into an image forming apparatus, and an image forming apparatus.

2. Description of the Related Art

An image forming apparatus such as a copier or a printer is such that toner is supplied from a developing device toward an electrostatic latent image formed on the outer surface of an image bearing member such as a photoconductive drum to form a toner image corresponding to the electrostatic latent image. This toner image is transferred to a sheet, which is discharged to the outside after a fixing process is applied thereto by heating and pressing in a fixing device.

In such an image forming apparatus, a detachably mountable toner container (toner supplying device) storing a specified amount of toner is attached to the developing device, and an amount of toner corresponding to an amount used for image formation is replenished into the developing device from a container body of this toner container. Normally, the toner container is attached to and detached from the developing device by being slid on a top plate of the developing device in forward and reverse directions. Such a toner container is provided with a toner replenishment opening and a shutter structure for opening and closing the toner replenishment opening at a lower surface side. On the other hand, the developing device is formed with a toner receiving opening at a position corresponding to the toner replenishment opening.

The shutter structure includes a shutter plate in the form of a flat plate which slides in parallel with the container body to open and close the toner replenishment opening by attaching and detaching the toner container to and from the developing device, an elastic arm extending in a sliding direction from one edge portion of the shutter plate and a container locking claw and a developing-device locking claw formed at the leading end of the elastic arm.

On the other hand, a container side engageable portion engageable with and disengageable from the container locking claw is provided near the toner replenishment opening on the toner container and a developing-device side engageable portion engageable with and disengageable from the developing-device locking claw is provided near the toner receiving opening on the developing device.

By linking the engagement and disengagement of the respective locking claws and the respective engageable portions with and from each other, the shutter plate having closed the toner replenishment opening is opened by attaching the toner container to the developing device and the opened toner replenishment opening is closed by the shutter plate by withdrawing the toner container from the developing device. Once the toner container is detached from the developing device, the shutter plate becomes a lock state by engagements of the container locking claw with the container side engageable portion, and will not be opened. Thus, the occurrence of such an inconvenience that the shutter is erroneously opened and the toner inside is leaked from the toner replenishment opening to outside of the toner container can be prevented.

In the conventional toner container provided with such a shutter structure, the container side engageable portion hinders a relative movement of the shutter plate with respect to the toner container in one direction (opposite to an attaching direction of the toner container) with the container locking claw of the shutter plate engaged with the container side engageable portion until the developing-device locking claw is engaged with the developing-device side engageable portion, but permits a movement in other direction at any point of time. In other words, the container side engageable portion is not in the form of a groove, but in the form of a step.

Accordingly, as the toner container once attached to the developing device is withdrawn, the shutter plate moves relative to the toner container since the developing-device locking claw is engaged with the developing device (i.e. the shutter plate does not move relative to the developing device). Thus, when the toner container is detached from the developing device, the shutter plate closes the toner replenishment opening.

However, while the toner container is being withdrawn from the developing device, a relative movement of the shutter plate with respect to the toner container is not hindered until the developing-device locking claw is disengaged from the developing-device side engageable portion. Thus, the shutter plate comes to close the toner replenishment opening. However, since no stopper is provided to hold the closed state by the shutter plate, there is a likelihood that the shutter plate is opened inadvertently by the shutter plate getting caught by something in a state where the toner container is detached from the apparatus body of the image forming apparatus.

SUMMARY OF THE INVENTION

An object of the present invention is to properly perform specified closing and opening operations of a shutter upon attaching or detaching a toner supplying device to or from an image forming apparatus and reliably prevent the shutter from being inadvertently opened after a container body is withdrawn from the image forming apparatus.

In order to accomplish this object, one aspect of the present invention is directed to a toner supplying device detachably mountable into an apparatus body of an image forming apparatus while being guided by a guiding portion formed in the apparatus body, comprising a container body formed with a toner replenishment opening and adapted to contain toner; a shutter for opening and closing the toner replenishment opening; and an opening/closing structure for causing the shutter to perform opening and closing operations as the container body is mounted into and detached from the apparatus body; wherein the opening/closing structure includes an arm projecting from the shutter in a mounting direction of the container body into the apparatus body and a locking portion attached to the arm; and the locking portion includes a first locking claw engageable with and disengageable from a first engageable portion for locking formed at the guiding portion and a second locking claw engageable with and disengageable from a second engageable portion for locking formed at the container body.

Another aspect of the present invention is directed to an image forming apparatus, comprising an apparatus body; an image bearing member provided in the apparatus body for bearing an electrostatic latent image; a developing device provided in the apparatus body for developing the electrostatic latent image formed on the image bearing member into a toner image; a toner supplying device detachably mountable into the apparatus body for supplying toner to the developing device; and a guiding portion formed in the apparatus body for guiding a mounting movement of the toner supplying device into the apparatus body, wherein the toner supplying device has the above construction.

These and other objects, features and advantages of the present invention will become more apparent upon a reading of the following detailed description. Further, advantages of the present invention will become more apparent in the following description with reference to accompanying drawings.

BRIEF DESCRIPTION OF THE DRAWINGS

FIGS. 4A and 4B are plan views showing a positional relationship of the toner container and the developing device, wherein FIG. 4A shows a state immediately before the toner container is attached to the developing device and FIG. 4B shows a state where the toner container is attached to the developing device, FIGS. 8A to 12B are diagrams showing functions of the opening/closing structure, wherein FIGS. 8A, 9A, 10A, 11A and 12A are plan views in section and FIGS. 8B, 9B, 10B, 11B and 12B are side views in section, FIGS. 8A, 8B show a state where the gate member of the toner container is fitted between a pair of wider guide walls of the guiding portion, FIGS. 9A, 9B show a state where arrowhead members are being fitted into guiding-portion side locking grooves by fitting a box-shaped case into the guiding portion, FIGS. 10A, 10B show a state where a shutter plate is set to an opening position by mounting the gate member into the guiding portion, FIGS. 11A, 11B show a state where the arrowhead members are being disengaged from the guiding-portion locking grooves by starting to withdraw the gate member from the guiding portion, FIGS. 12A, 12B show a state where the gate member is being withdrawn from the guiding portion.

DETAILED DESCRIPTION OF THE PREFERRED EMBODIMENTS

Figure 1:
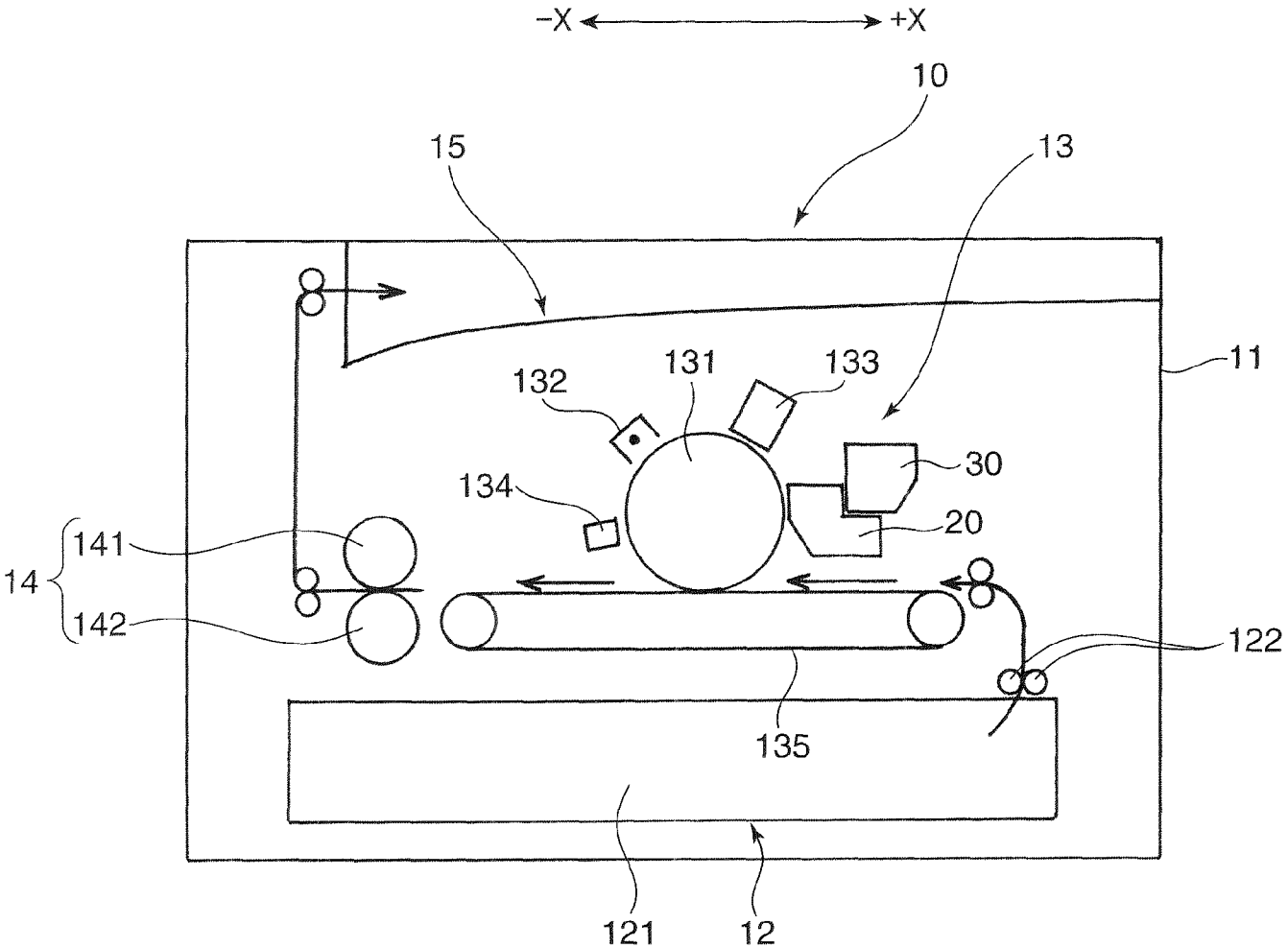
FIG. 1 is a schematic diagram showing the internal construction of an image forming apparatus according to one embodiment of the invention.

FIG. 1 is a schematic diagram showing the internal construction of an image forming apparatus 10 according to one embodiment of the present invention. In FIG. 1, X directions are referred to as lateral directions, wherein, particularly, −X direction and +X direction are respectively referred to as leftward and rightward directions. The image forming apparatus 10 is used as a printer and formed such that a sheet feeding unit 12 for feeding stored sheets according to needs, an image forming unit 13 for transferring a image to a sheet fed from the sheet feeding unit 12 and a fixing unit 14 for applying a fixing process to the sheet having the image transferred in image forming unit 13 are provided in an apparatus body 11 and a discharge unit 15, to which the sheet after the fixing process is discharged, is provided at a position on the upper surface of the apparatus body 11.

The sheet feeding unit 12 feeds sheets of a sheet stack placed in a sheet cassette 121 one by one from the uppermost one toward the image forming unit 13 by the rotation of feed rollers 122.

The image forming unit 13 is arranged substantially at a central position in the apparatus body 11 and transfers a toner image onto a sheet by an electrophotographic process. The image forming unit 13 includes a photoconductive drum (image bearing member) 131 which is rotatably supported and photoconductive, a charging device 132, an exposure device 133, a developing device 20 and a cleaning device 134, wherein the devices 132, 133, 20 and 134 are successively arranged around the photoconductive drum 131 in a rotating direction of the photoconductive drum 131. A sheet fed from the sheet cassette 121 by driving the feed rollers 122 is fed toward the circumferential surface of the photoconductive drum 131 by driving a conveyor belt 135.

The developing device 20 forms a toner image on the circumferential surface of the photoconductive drum 131 by supplying toner to the circumferential surface of the photoconductive drum 131. A detachably attachable toner container 30 (see FIG. 2 and other figures; toner supplying device as claimed) for replenishing the developing device 20 with toner is attached to the developing device 20.

The fixing unit 14 is arranged downstream of the conveyor belt 135 in a sheet conveying direction. The fixing unit 14 includes a heating roller 141 and a pressure roller 142 and fixes a toner image on a sheet to the sheet through a heating process by the heating roller 141 and the pressing by the both rollers 141, 142 by permitting the sheet having the toner image transferred thereto in the image forming unit 13 to pass between the heating roller 141 and the pressure roller 142.

A basic operation of such an image forming apparatus 10 is described. The circumferential surface of the photoconductive drum 131 rotating clockwise in FIG. 1 is first uniformly charged by the charging device 132. Subsequently, the circumferential surface of the photoconductive drum 131 is irradiated with light from the exposure device 133 based on image information transmitted from an external apparatus such as a computer, thereby forming an electrostatic latent image on the circumferential surface of the photoconductive drum 131. The electrostatic latent image is developed by supplying toner from the developing device 20 to this electrostatic latent image, and a toner image is formed on the circumferential surface of the photoconductive drum 131.

A sheet fed from the sheet cassette 121 of the sheet feeding unit 12 is conveyed toward the photoconductive drum 131 having the toner image formed thereon by driving the conveyor belt 135, and the toner image on the circumferential surface of the photoconductive drum 131 is transferred to the sheet by the function of an unillustrated transfer roller facing the photoconductive drum 131. The sheet having the toner image transferred thereto is separated from the photoconductive drum 131 and conveyed toward the fixing unit 14 by driving the conveyor belt 135. The toner image is fixed to the sheet through the heating by the heating roller 141 and pressing in the fixing unit 14. The sheet after the fixing process is discharged onto a discharge tray 151 of the discharge unit 15. The circumferential surface of the photoconductive drum 131 after the toner image is transferred to the sheet is cleaned by the cleaning device 134 and returned to the charging device 132 for a next image forming process.

Figure 2A:
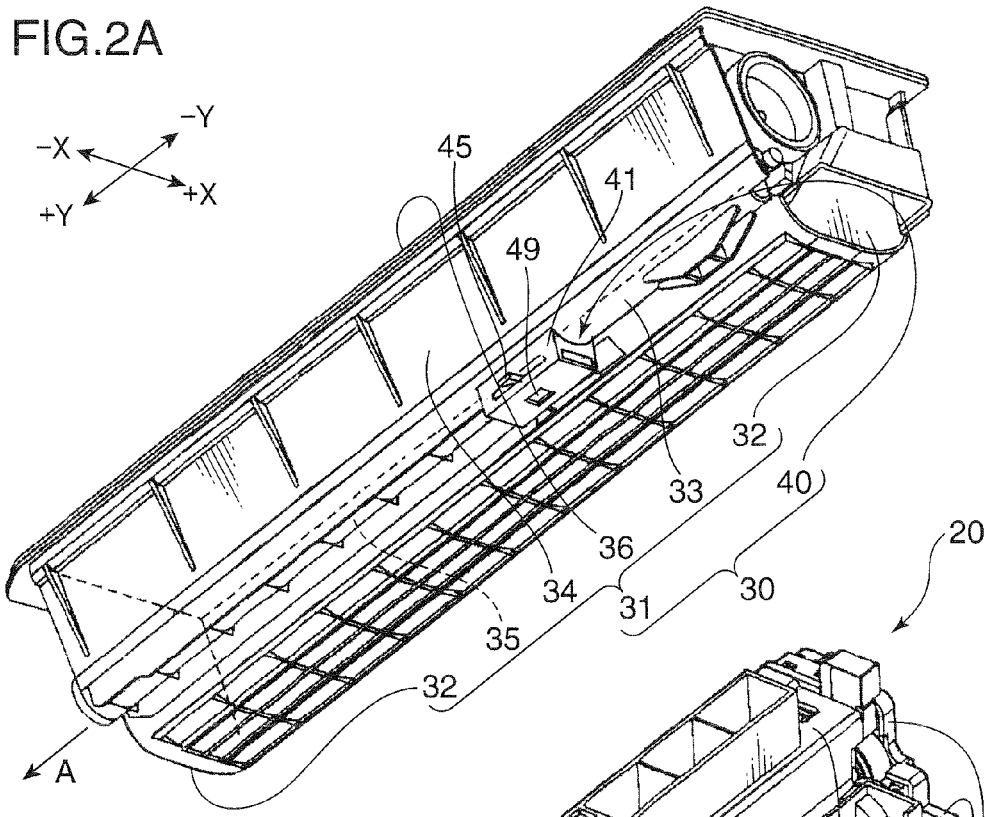
FIG. 2A is a perspective view showing a toner container according to the embodiment of the invention and FIG. 2B is a perspective view showing a developing device, to and from which the toner container is to be attached and detached.
Figure 2B:
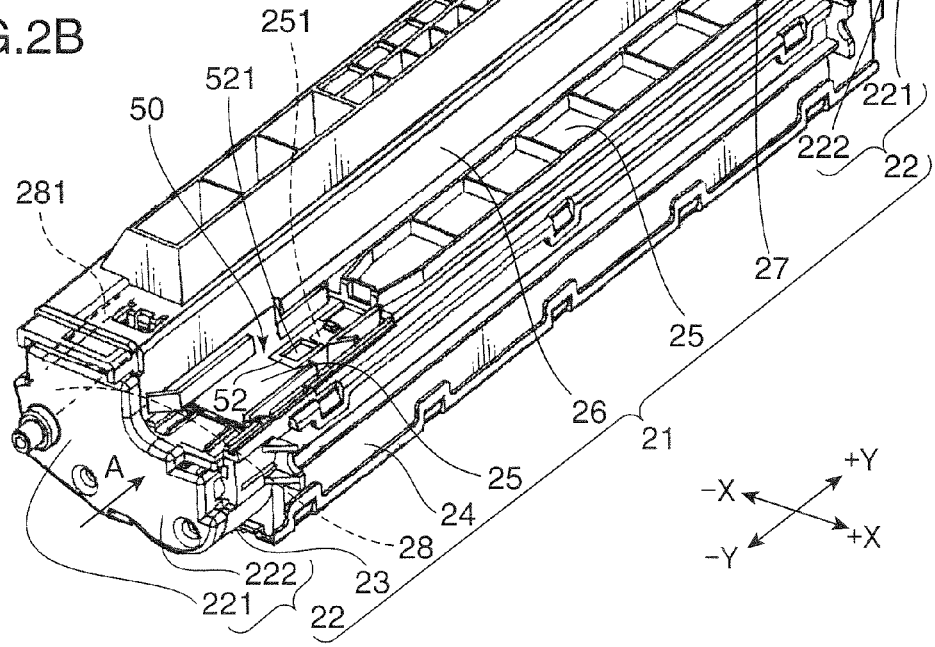
Figure 3:
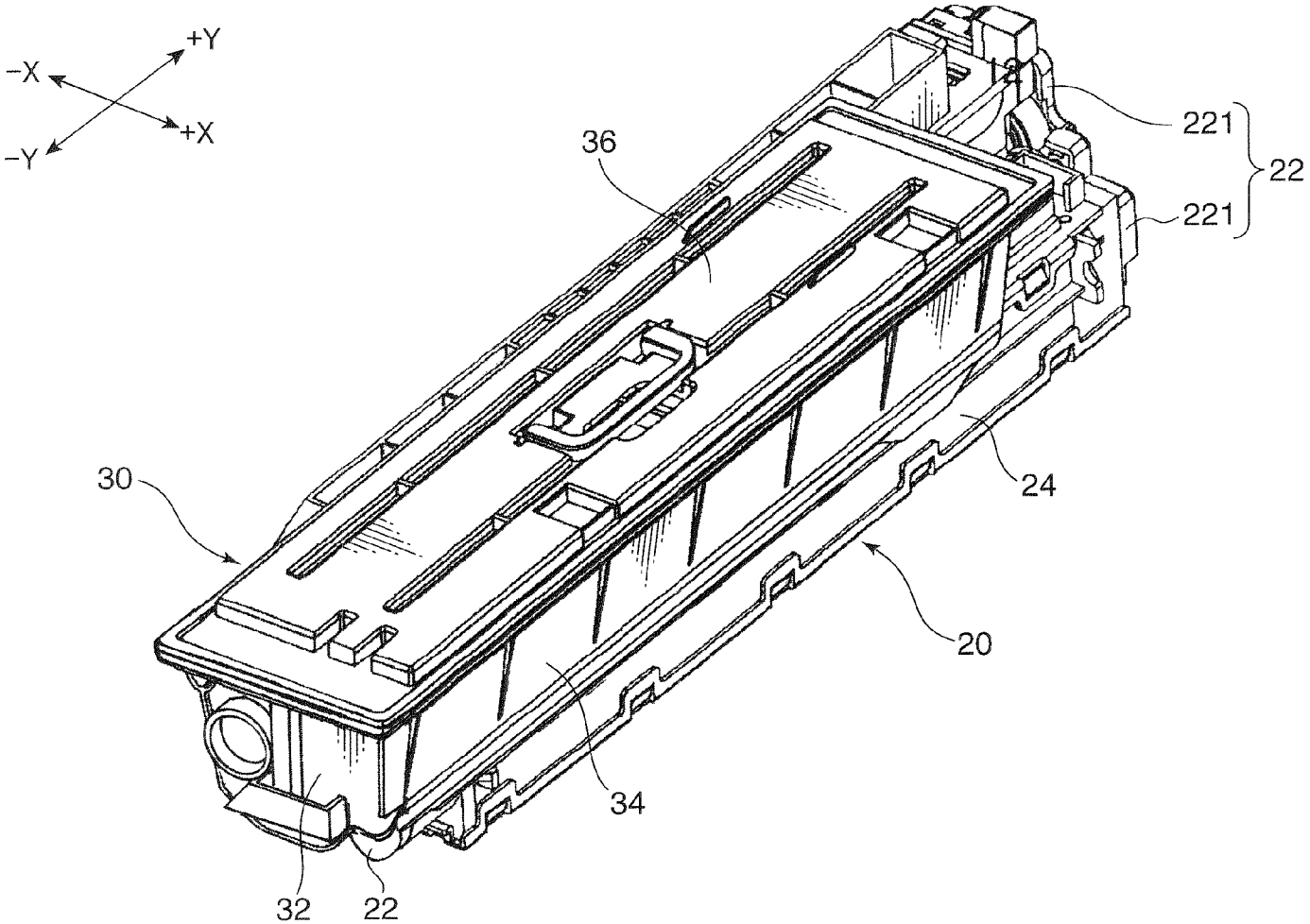
FIG. 3 is a perspective view showing a state where the toner container is attached to the developing device.
Figure 4A:
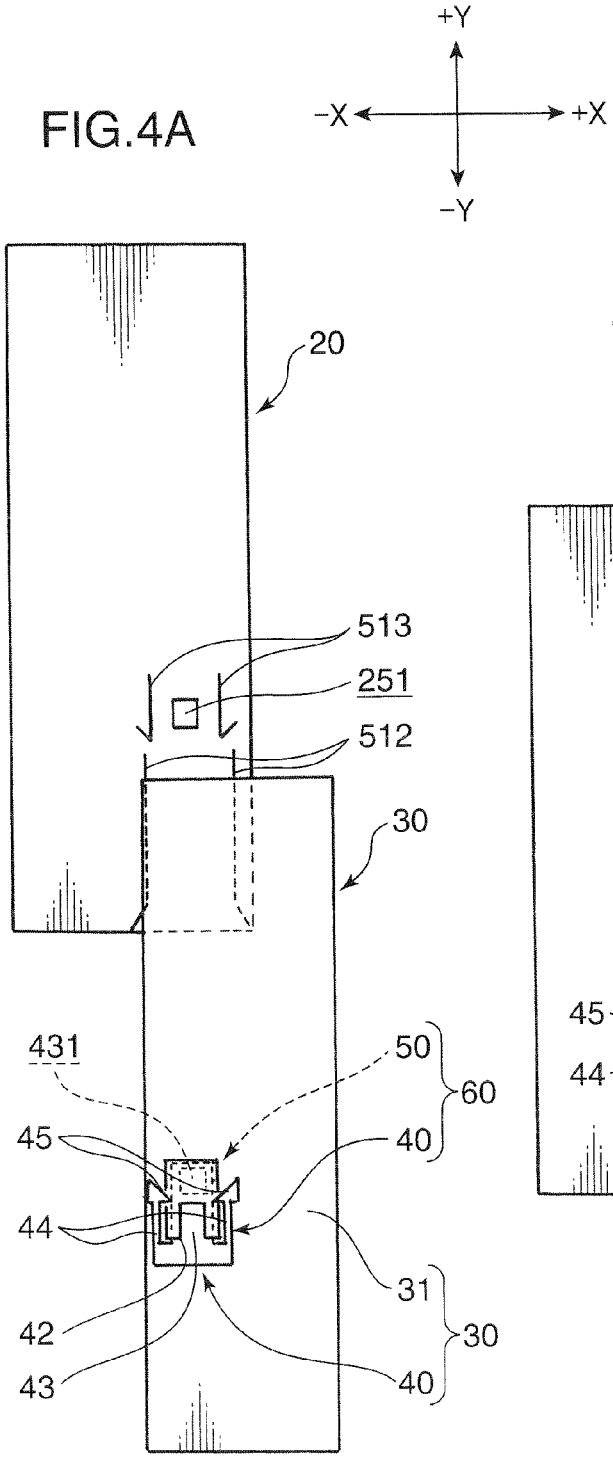
Figure 4B:
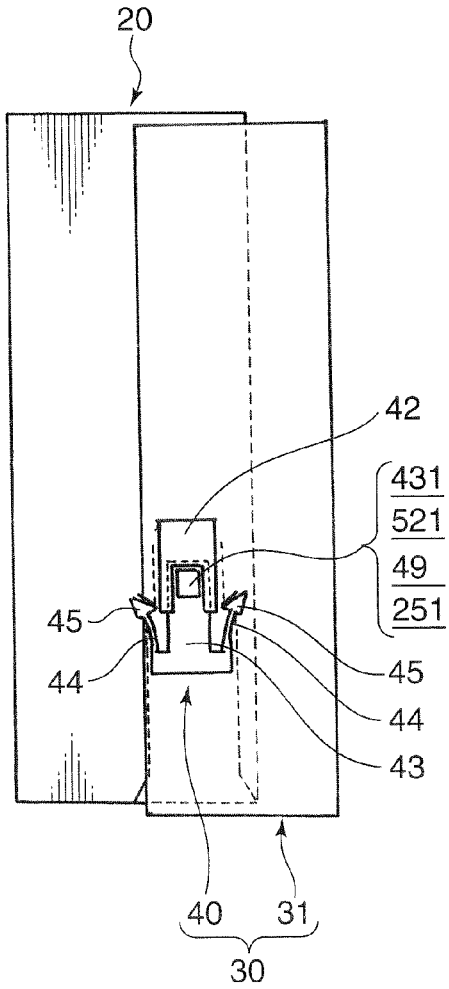

FIGS. 2A, 2B and 3 are perspective views showing the toner container 30 according to this embodiment and the developing device 20, to which the toner container 30 is detachably attached. FIGS. 2A and 2B respectively show a state before the toner container 30 is attached to the developing device 20, and FIG. 3 shows a state where the toner container 30 is attached to the developing device 20. FIGS. 4A, 4B are diagrams showing a positional relationship of the toner container 30 and the developing device 20, wherein FIG. 4A shows a state immediately before the toner container 30 is attached to the developing device 20 and FIG. 4B shows a state where the toner container 20 is attached to the developing device 20.

In FIGS. 2A, 2B and 3, X-X directions are referred to as width directions and Y-Y directions as forward and backward directions, wherein −X direction is referred to as leftward direction, +X direction as rightward direction, −Y direction as forward direction and +Y direction as backward direction. In FIGS. 2A, 2B, indication of forward and backward directions of the toner container 30 is opposite to those of the developing device 20.

As shown in FIG. 2B, the developing device 20 is L-shaped in an end view (front view) and internally provided with an agitating member, for example, including an agitating fins for agitating toner supplied into a developing device body 21 from the toner container 30 and a developing roller for supplying the agitated toner to the circumferential surface of the photoconductive drum 131 (FIG. 1). The developing device body 21 includes a pair of side plates 22 facing in the forward and backward directions. Each side plate 22 is set such that a vertical dimension of a left part 221 is longer than that of a right part 222, and the L-shaped end surface is formed by these left part 221 and the right part 222.

A bottom plate 23 extends between the lower edges of the pair of side plates 22, and a right plate 24 extends between the right edges of the right parts 222 of the pair of side plates 22. Further, a lower top plate 25 extends between the upper edges of the pair of right parts 222, whereas an intermediate plate 26 extends between the right edges of the pair of left parts 221. Furthermore, an upper top plate 27 extends between the pair of left parts 221 and a left plate 28 extends between the left edges of the pair of left parts 221. The developing device body 21 includes a toner agitation space enclosed and sealed by these respective plates 22 to 28. The left plate 28 is formed with an opening 281 facing the developing roller and extending in forward and backward directions. Toner in the developing device 20 is supplied to the circumferential surface of the photoconductive drum 131 from the developing roller facing the photoconductive drum 131 via this opening 281.

A guiding portion 50 for guiding a gate member 40 of the toner container 30 to be described later is provided at a front position of the lower top plate 25. The guiding portion 50 is formed with a toner receiving opening 251 having a rectangular plan view and adapted to receive toner. The gate member 40 includes a rectangular parallelepipedic boxed-shaped case 41 disposed at a front position of the left side of the bottom plate 33 of the container body 31, and various members for a shutter to be described later are mounted in this box-shaped case 41. A toner replenishment opening 49 for replenishing the developing device 20 with toner in the container body 31 is formed in a bottom plate of the box-shaped case 41.

As shown by an arrow A in FIG. 2A, the toner container 30 is attached to the developing device 20 by fitting the rear end of the toner container 30 on the front end of the lower top plate 25 of the developing device body 21 and being slid while being guided by the intermediate plate 26 and the upper top plate 27. Thus, toner from the toner container 30 is replenished into the developing device 20 via the toner replenishment opening 49 of the gate member 40 and the toner receiving opening 251 of the lower top plate 25. In this embodiment, the lower top plate 25 of the developing device 20 is a portion where the toner container 30 is detachably attached.

The toner container 30 is provided with a box-shaped container body 31 having a length (dimension in forward and backward directions) substantially equal to that of the developing device 20 and including an unillustrated agitating/conveying member inside, and the gate member 40 disposed at the bottom of this container body 31 in correspondence with the guiding portion 50.

The container body 31 includes a pair of side plates 32 positioning in forward and backward directions, a bottom plate 33 extending between the lower edges of the side plates 32, a left plate 34 extending between the left edges of the pair of side plates 32, and a right plate 35 extending between the right edges of the pair of side plates 32. An opening in the upper surface of the container body 31 is closed by a lid 36.

The gate member 40 is provided on the left side of the bottom plate 33 and at a position slightly before a central position in forward and backward direction of the bottom plate 33 in correspondence with the guiding portion 50. The toner container 30 is set at an attachment position on the developing device body 21 (an inner corner portion formed by the lower top plate 25 and the intermediate plate 26) by the rear end of the toner container 30 being engaged with the front end of the developing device 20 and slid toward the rear end of the developing device 20 as shown in FIG. 4A, whereby the toner replenishment opening 49 of the toner container 30 is opened as shown in FIG. 4B. By this opening, toner in the toner container 30 is replenished into the developing device 20.

Figure 5:
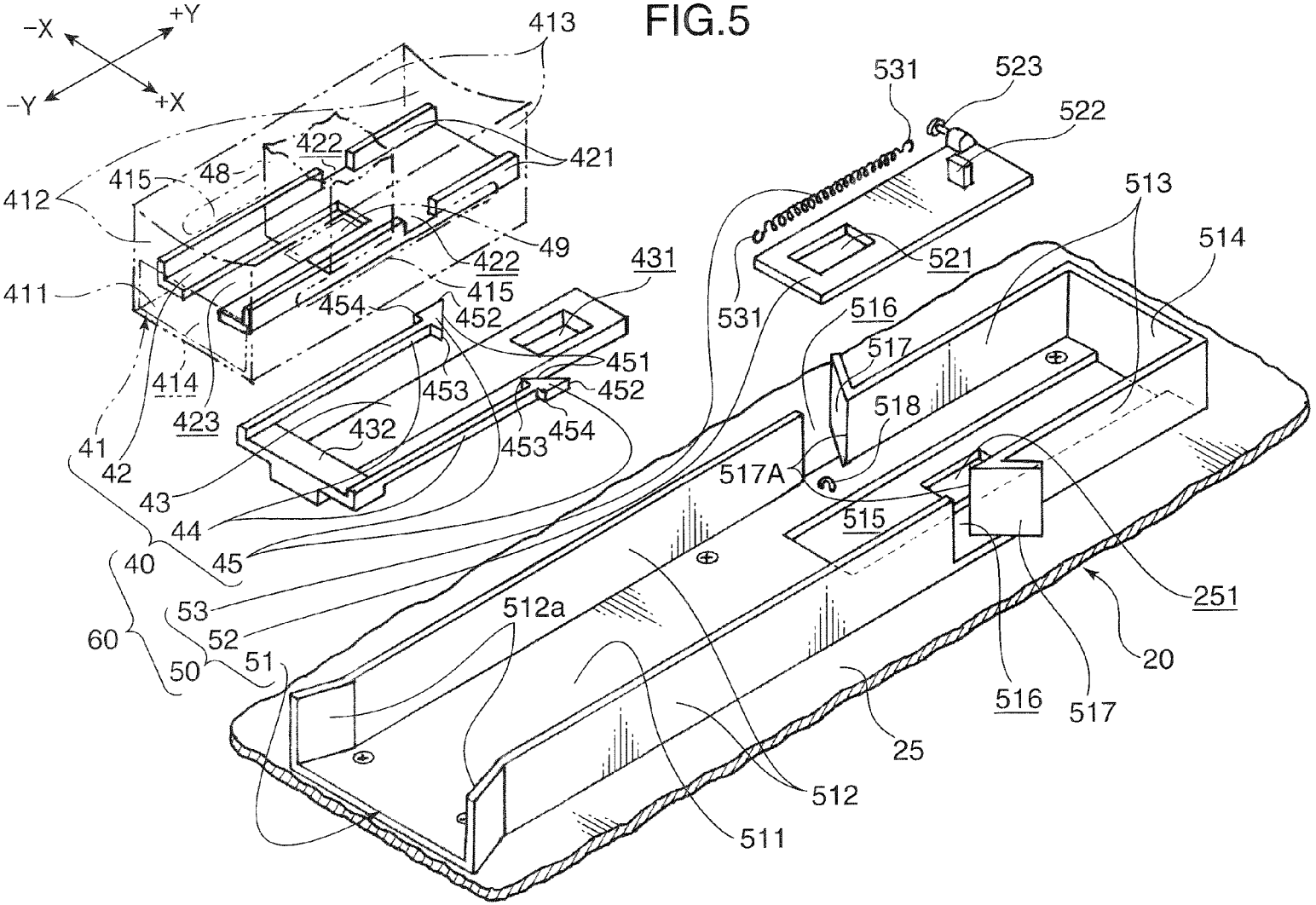
FIG. 5 is an exploded perspective view showing one embodiment of an opening/closing structure.
Figure 6:
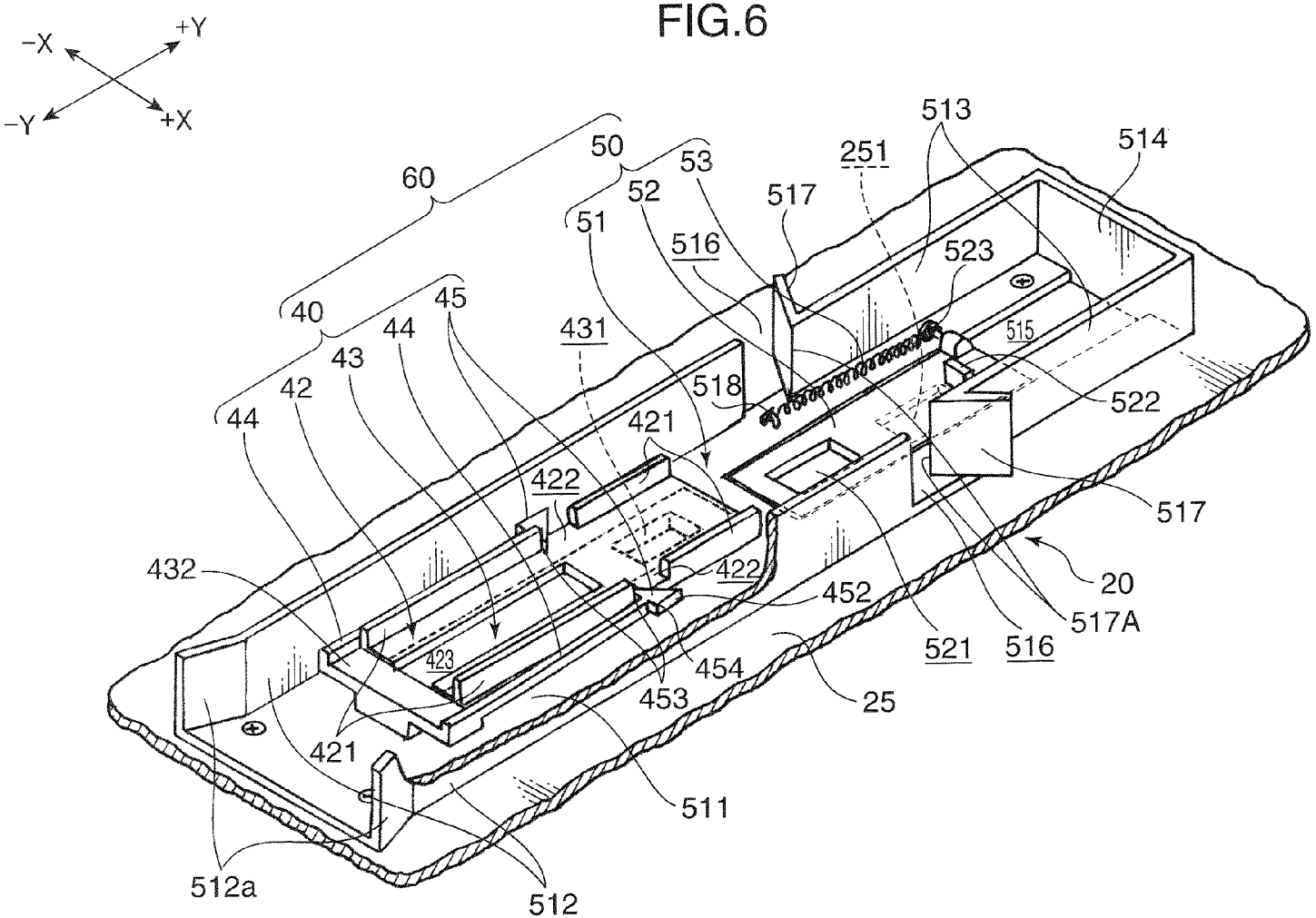
FIG. 6 is an assembled perspective view partly cut away of the opening/closing structure shown in FIG. 5 showing a state where a gate member is moving ahead while being guided by a guiding portion.
Figure 7:
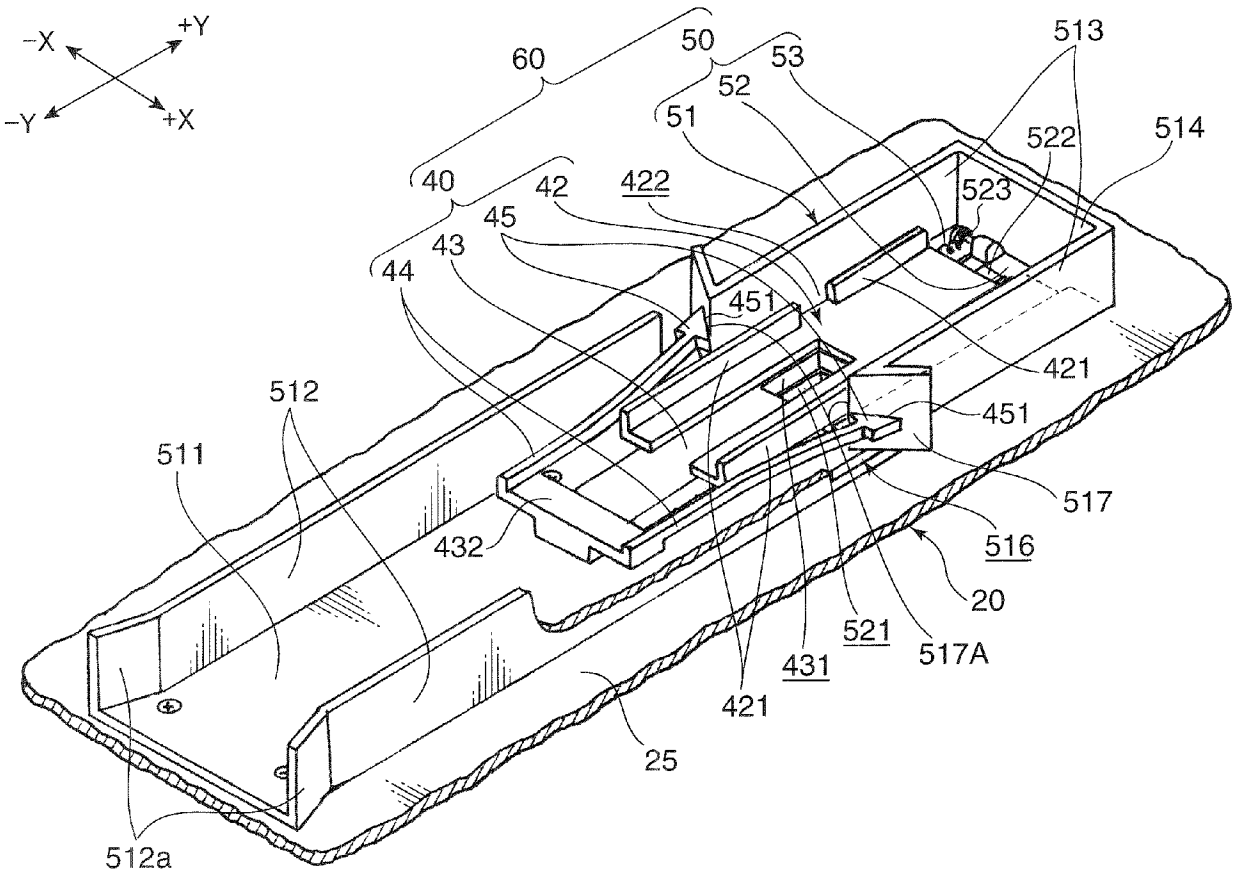
FIG. 7 is an assembled perspective view partly cut away of the opening/closing structure shown in FIG. 5 showing a state where the gate member is pushed to a backmost part of the guiding portion.

An opening/closing structure 60 for opening and closing a shutter plate (shutter) 43 as the toner container 30 is attached to and detached from the developing device 20 is described below with reference to FIGS. 5 to 7. FIG. 5 is an exploded perspective view and FIGS. 6 and 7 are partial assembled perspective views partly cut away showing one embodiment of the opening/closing structure 60. Particularly, FIG. 6 shows a state where the gate member 40 is moving ahead while being guided by the guiding portion 50, and FIG. 7 shows a state where the gate member 40 is pushed to a backmost part of the guiding portion 50. Indication of directions by X and Y in FIGS. 5 to 7 is the same as in the case of FIGS. 2A and 2B (−X: leftward, +X: rightward, −Y: forward, +Y: backward).

As shown in FIG. 5, the opening/closing structure 60 for opening and closing the shutter plate 43 includes the gate member 40 provided at the front position of the bottom plate 33 of the container body 31 for guiding a movement of the shutter plate 43, and the guiding portion 50 formed at the front position of the lower top plate 25 of the developing device 20.

The gate member 40 includes a forked plate 42 arranged integral to the box-shaped case 41 at an upper position in the box-shaped case 41 shown by solid line in FIG. 2A and by chain double-dashed line in FIG. 5, the shutter plate 43 arranged below the forked plate 42 in such a manner as to be movable in forward and backward directions while being held in sliding contact with the forked plate 42, a pair of left and right elastic arms (arms) 44 projecting backward from front positions of the shutter plate 43, and a pair of arrowhead members (locking portions) 45 respectively formed at the leading ends (rear ends) of the respective elastic arms 44.

The box-shaped case 41 includes a bottom plate (bottom portion) 411 which is rectangular slightly longer in forward and backward directions in a plan view, a pair of front and rear plates 412 extending between front and rear edges of the bottom plate 411 and the bottom plate 33 of the container body 31, and a pair of left and right side plates 413 interposed between the left and right edges of the bottom plate 411 of the box-shaped case 41 and the bottom plate 33 of the container body 31. The toner replenishment opening 49 for replenishing toner in the container body 31 into the developing device 20 via the gate member 40 is formed in a central part of the bottom plate 411.

The front plate 412 in the front side is formed with an escaping window 414. This escaping window 414 is for permitting the shutter plate 43 to escape to the outside of the box-shaped case 41 when the shutter plate 43 moves forward relative to the box-shaped case 41. Each of the side plates 413 of the box-shaped case 41 is formed with an oblong hole 415 extending in forward and backward directions and permitting the corresponding arrowhead member 45 moving forward and backward relative to the box-shaped case 41 to project outward from the box-shaped case 41. Such a box-shaped case 41 is not shown in FIGS. 6 and 7 since the box-shaped case 41 makes graphical representation more complicated.

The forked plate 42 is set such that a lateral dimension thereof is shorter than that of the bottom plate 411 and a dimension thereof in forward and backward directions is slightly shorter than the spacing between the inner surfaces of the pair of front and rear plates 412. Edge ribs 421 projecting upward and extending in forward and backward directions are provided along the left and right edges of the forked plate 42. A container side locking grooves (second engageable portions) 422 in the form of a recess is arranged in a substantially central part of each of these edge ribs 421 by forming a cutout extending from the upper edges thereof. These container side locking grooves 422 are engageable with inner locking claws 453 of the arrowhead members 45 to be described later.

The forked plate 42 is also formed with a cutout opening 423 by forming a cutout extending from the front edge to a substantially central part. A tubular body 48 is interposed between the bottom plate 33 of the container body 31 and the forked plate 42. The tubular body 48 is so placed as to cover the back side of the cutout opening 423. Toner in the container body 31 is replenished into the developing device 20 though the tubular body 48 and the cutout opening 423 with the shutter plate 43 relatively positioned at an opening position with respect to the forked plate 42.

A dimension of the shutter plate 43 in forward and backward directions is set substantially equal to that of the forked plate 42, and a lateral width thereof is set shorter than the spacing between the inner sides of the pair of edge ribs 421 of the forked plate 42 and slightly larger than that of the cutout opening 423 of the forked plate 42. A passage hole 431 for permitting the passage of toner is formed at a rear position of the shutter plate 43. The passage hole 431 is located behind the cutout opening 423 of the forked plate 42 with the shutter plate 43 set at a closing position, whereby the replenishment of toner in the container body 31 into the developing device 20 is hindered.

A supporting block 432 extending in a lateral direction is fixed on the upper part of the front edge of the shutter plate 43 to support the base ends (front ends) of the respective elastic arms 44. The supporting block 432 is set such that a lateral length thereof is larger than the spacing between the outer sides of the pair of edge ribs 421 of the forked plate 42 and smaller than the spacing between the inner surfaces of the pair of wider guide walls 512 of the guiding portion 50 to be described later.

The pair of elastic arms 44 have the base ends thereof fixed to the upper surfaces of the left and right ends of the supporting block 432 so as to extend backward (attaching direction of the toner container 30) in parallel with each other. In this embodiment, the length of the elastic arms 44 is set slightly longer than half the length of the shutter plate 43 in forward and backward directions.

The vertical thickness of the supporting block 432 is set equal to the thickness of the forked plate 42. Accordingly, the upper surfaces of the supporting block 432 and the forked plate 42 are flush by placing the forked plate 42 on the shutter plate 43 as shown in FIG. 6.

The arrowhead members 45 extend backward from the rear ends (leading ends in the attaching direction of the toner container 30) of the respective elastic arms 44. The arrowhead members 45 are set to have laterally symmetric right triangular shapes in a plan view with respect to a center line of the shutter plate 43 extending in forward and backward directions. The respective arrowhead members 45 are fixed to the rear ends of the elastic arms 44 at the centers of base parts thereof so that hypotenuse parts (hypotenuse edges 451) of the right triangular shapes laterally face each other.

In the pair of arrowhead members 45, pointed portions (leading-end interfering portions) 452 are respectively formed at the leading ends (rear ends) of the hypotenuse edges 451. Further, a pair of left and right inner locking claws (second locking claws) 453 projecting from the elastic arms 44 in directions toward each other are formed at the front end positions of the hypotenuse edges 451 of the respective arrowhead members 45. Furthermore, outer locking claws (first locking claws) 454 projecting in directions away from each other from the rear ends of the respective elastic arms 44 are respectively formed at positions of the arrowhead members 45 corresponding to the right angles of the right triangular shapes.

Each outer locking claw 454 projects in an outward direction (one lateral direction) orthogonal to a forward-and-backward axis of the elastic arm 44 parallel with the attaching direction of the toner container 30. On the contrary, each inner locking claw 453 projects in an inward direction (other lateral direction) orthogonal to the above forward-and-backward axis.

The spacing between the outer sides of the respective arrowhead members 45 is set slightly larger than the spacing between the inner surfaces of the pair of wider guide walls 512 of the guiding portion 50 to be described later. Accordingly, with the box-shaped case 41 mounted between the pair of wider guide walls 512, the respective elastic arms 44 are so elastically deformed as to move the rear end sides thereof closer to each other in the facing directions as shown in FIG. 6 although only to a slight extent. In response to these elastic deformations, the outer edge surfaces of the respective arrowhead members 45 are pressed into contact with the wider guide walls 512 (see also FIG. 8A).

The guiding portion 50 is mounted at a suitable front position on the lower top plate 25 (see FIG. 2B) of the developing device 20 in correspondence with the gate member 40. The guiding portion 50 includes a guide member 51 for guiding forward and backward movements of the box-shaped case 41 of the gate member 40, a shutter board 52 provided movably forward and backward with respect to the guide member 51 and a coil spring 53 as a biasing member for applying a biasing force to the shutter board 52.

The guide member 51 includes a base plate 511, the pair of left and right wider guide walls 512, a pair of left and right narrower guide walls 513 and a stopper wall 514. The base plate 511 is fixed to the lower top plate 25 of the developing device 20 by screws. The wider guide walls 512 stand from the left and right edges of the base plate 511 in a range from the front end position of the base plate 511 to a position slightly behind a central part in forward and backward directions of the base plate 511. The narrower guide walls 513 extend from positions behind the wider guide walls 512 to the rear edge of the base plate 511 while being spaced apart from the wider guide walls 512 in the mounting direction of the toner container 30. The stopper wall 514 extends between the rear edges of the pair of narrower guide walls 513.

A shutter-plate mount groove 515 is formed in a part of the base plate 511 behind the substantially central position in forward and backward directions by making a cutout at a lateral middle position. The toner receiving opening 251 corresponding to the toner replenishment opening 49 of the toner container 30 is formed in a part of the lower top plate 25 of the developing device 20 corresponding to a substantially central part of the shutter-plate mount groove 515 in forward and backward directions.

The pair of wider guide walls 512 are arranged laterally symmetrically with respect to a center line of the base plate 511 extending in the forward and backward directions, and set such that the spacing between the inner surfaces thereof is slightly larger than the outer lateral dimension of the box-shaped case 41. When the pair of arrowhead members 45 are inserted between the pair of wider guide walls 512 in the process of attaching the toner container 30 to the developing device 20, the outer edge surfaces of the respective arrowhead members 45 are relatively pressed by this pair of wider guide walls 512, whereby the respective elastic arms 44 are slightly curved. Inclined walls 512*a* are formed at front end portions of the respective wider guide walls 512. The spacing between the inner surfaces of the inclined walls 512*a* gradually increases toward the front. Thus, a user can easily mount the gate member 40 into the guiding portion 50 through the front opening between the pair of wider guide walls 512 upon attaching the toner container 30 to the developing device 20.

The pair of narrower guide walls 513 are arranged laterally symmetrically with respect to a center line of the base plate 511 extending in forward and backward directions, and the spacing between the inner surfaces thereof is set slightly larger than the spacing between the outer surfaces of the pair of side plates 413 of the box-shaped case 41. Thus, the user can push the box-shaped case 41 into between the pair of narrower guide walls 513 via the pair of wider guide walls 512 upon attaching the toner container 30 to the developing device 20. Further, the spacing between the pair of narrower guide walls 513 is set slightly smaller than the spacing between the pair of wider guide walls 512.

Guiding-portion side locking grooves (first engageable portions) 516 are gaps between the rear end edges of the respective wider guide walls 512 and the front end edges of the respective narrower guide walls 513. Further, guide wings (inclined portions) 517 project obliquely backward toward the opposite sides from the front end edges of the respective narrower guide walls 513.

The respective guide wings 517 guide the arrowhead members 45 provided at the leading ends of the elastic arms 44 of the gate member 40 toward the guiding-portion side locking grooves 516 as shown in FIG. 7 when the box-shaped case 41 is moved from a space between the pair of wider guide walls 512 to a space between the pair of narrower guide walls 513 upon attaching the toner container 30 to the developing device 20. By this guiding, the inner locking claws 453 are disengaged from the front edges of the container side locking grooves 422.

During this guiding, the pointed portions 452 of the arrowhead members 45 first come into contact with base ends 517A of the guide wings 517 and, thereafter, the hypotenuse edges 451 come into sliding contact with the guide wings 517. Since the spacing between the pair of narrower guide walls 513 is slightly smaller than that between the pair of wider guide walls 512, the base ends 517A of the guide wings 517 are located more inwardly than the inner wall surfaces of the wider guide walls 512. Such position setting enables the realization of the above guiding operation.

The shutter board 52 is so fitted into the shutter-plate mount groove 515 as to be movable forward and backward. When the toner container 30 is not attached to the developing device 20, the shutter board 52 closes the toner receiving opening 251 by being positioned in the forward portion of the shutter-plate mount groove 515 by a biasing force of the coil spring 53.

The thickness of the shutter board 52 is set equal to that of the base plate 511, whereby the upper surface of the shutter board 52 is flush with that of the base plate 511 with the shutter board 52 fitted in the shutter-plate mount groove 515. The length of the shutter board 52 in forward and backward directions is set slightly shorter than that of the shutter-plate mount groove 515 and the lateral width thereof is set slight shorter than the lateral dimension of the shutter-plate mount groove 515. Thus, the shutter board 52 can slide forward and backward in the shutter-plate mount groove 515 while being fitted in the shutter-plate mount groove 515.

A passage hole 521 for permitting the passage of toner from the toner container 30 is formed at the position of the shutter board 52 slightly before a central part in forward and backward directions. A pressable projecting piece 522 to be pressed by the rear end edge of the shutter plate 43 projects upward at a rear position of the shutter board 52.

A locking projecting piece 523 to be engaged with a rear hook 531 of the coil spring 53 is provided on the rear end of the left edge of the shutter board 52. Further, a locking ring 518 to be engaged with a front hook 531 of the coil spring 53 is provided at a suitable position of the left side of the base plate 511. The coil spring 53 is stretched via the front and rear hooks 531 thereof between the locking ring 518 and the locking projecting piece 523. Thus, the shutter board 52 is set at a front position in the shutter-plate mount groove 515 as shown in FIG. 6 while a biasing force of the coil spring 53 is applied thereto. At this time, the toner receiving opening 251 of the developing device 20 is closed by the rear half of the shutter board 52.

In this state, if the user fits the box-shaped case 41 into the guiding portion 50 and pushes the box-shaped case 41 backward to attach the toner container 30 to the developing device 20, the rear edge of the forked plate 42 pushes the pressable projecting piece 522 backward. This causes the shutter board 52 to move backward in the shutter-plate mount groove 515 as shown in FIG. 7. By this movement, the toner receiving opening 251 is opened as shown in FIG. 10B.

Figure 8A:
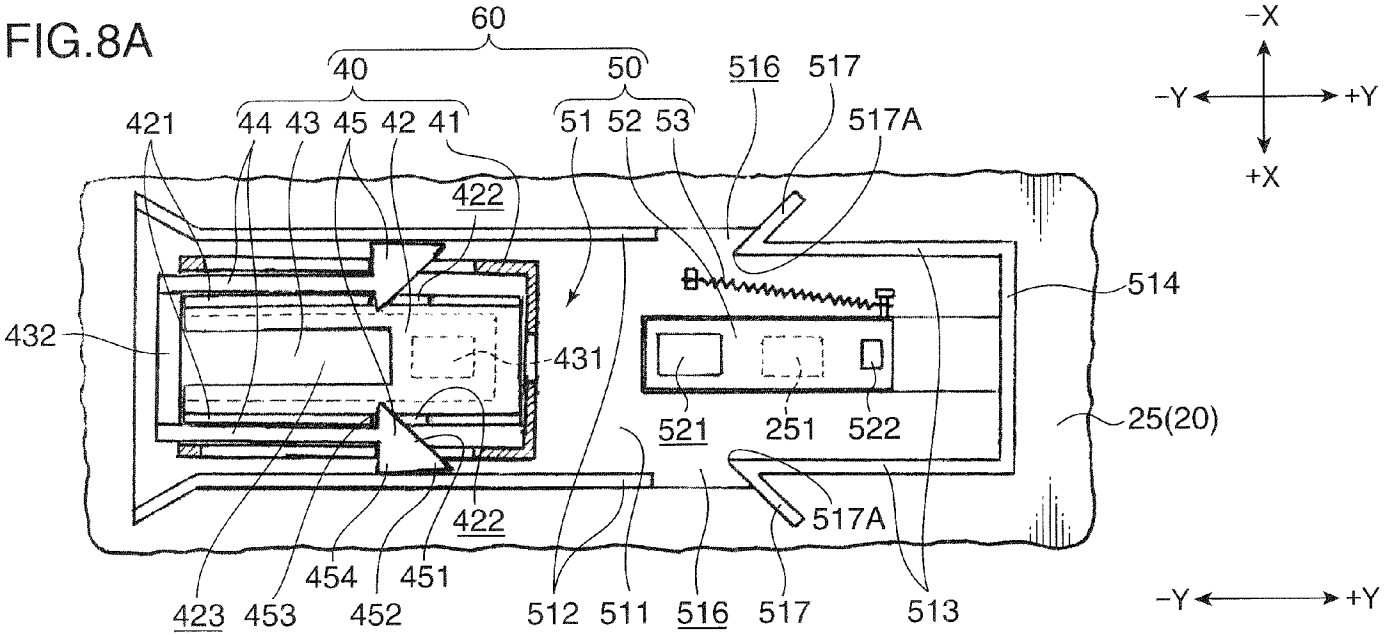
Figure 8B:
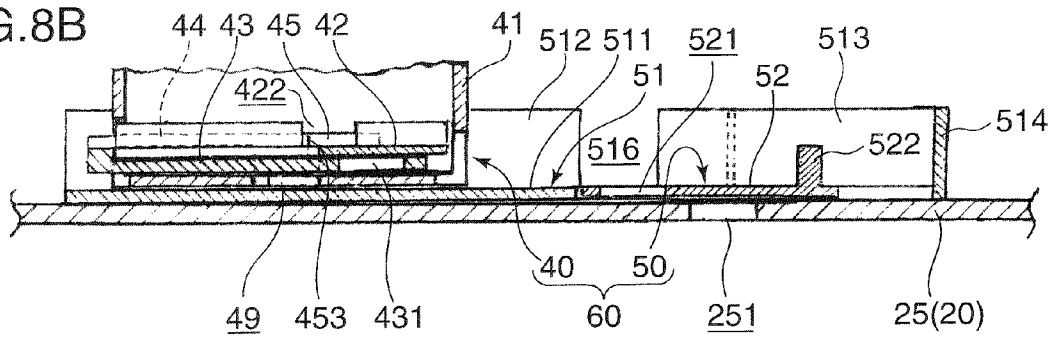
Figure 9A:
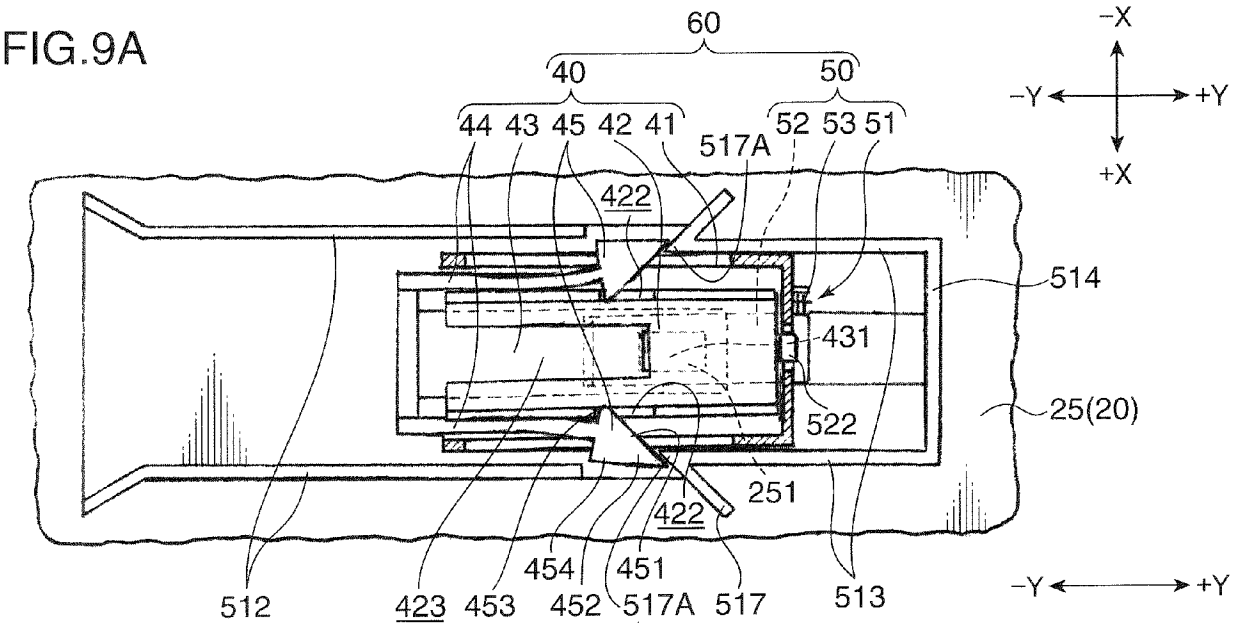
Figure 9B:
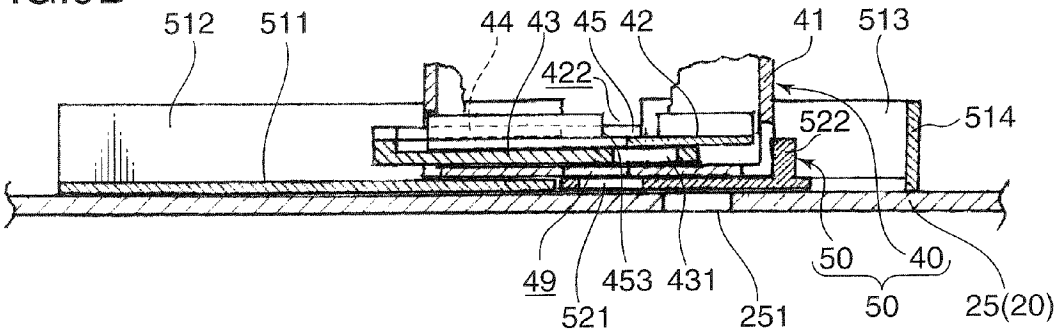

The functions of the opening/closing structure 60 according to this embodiment are described below with reference to FIGS. 8A to 12B. FIGS. 8A, 8B show a state immediately after the gate member 40 of the toner container 30 is fitted between the pair of wider guide walls 512 of the guiding portion 50, and FIGS. 9A, 9B show a state where the hypotenuse edges 451 of the respective arrowhead members 45 of the gate member 40 interfere with the guide wings 517 of the guiding portion 50 by fitting the box-shaped case 41 into the guiding portion 50 and the arrowhead members 45 are about to be fitted into the guiding-portion side locking grooves 516.

Figure 10A:
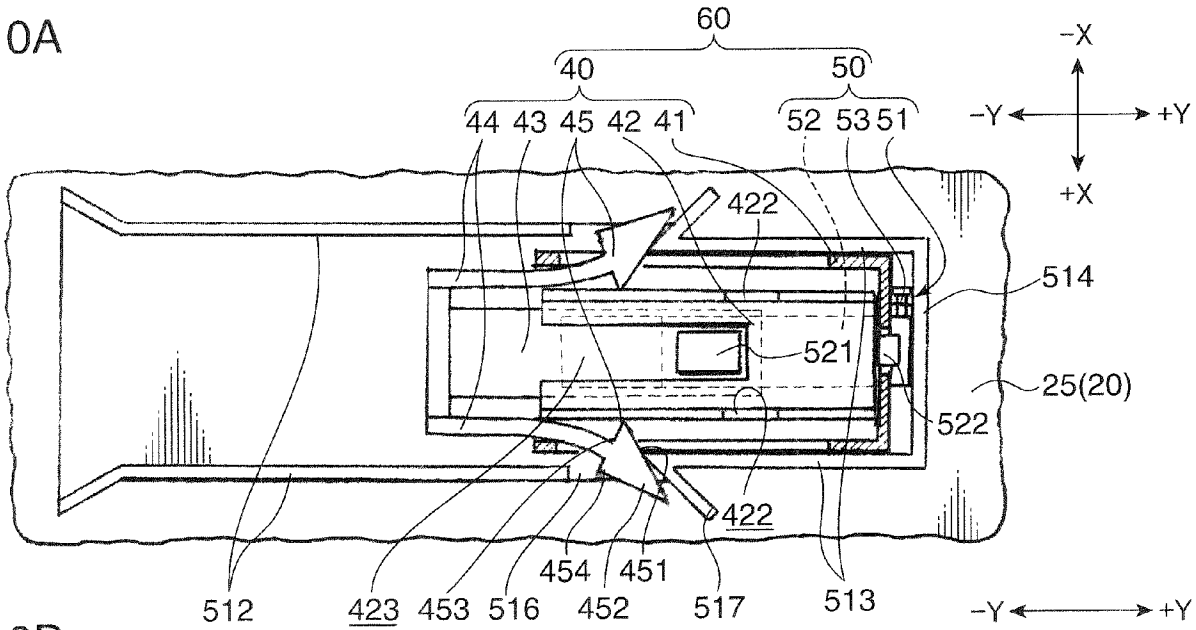
Figure 10B:
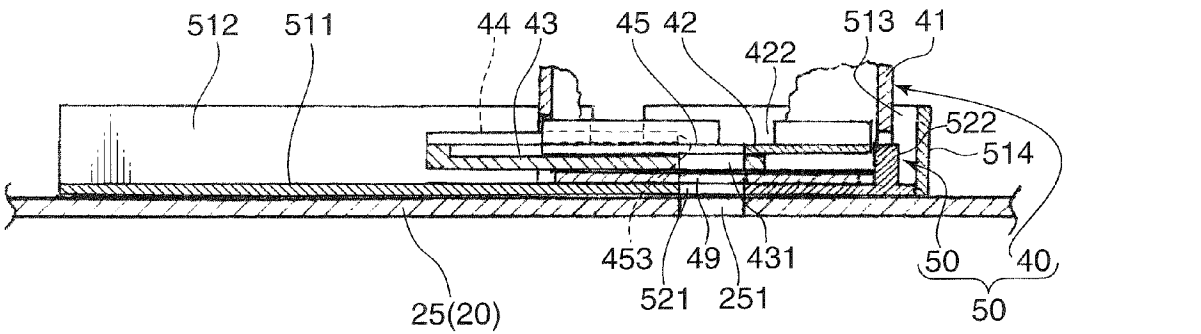
Figure 11A:
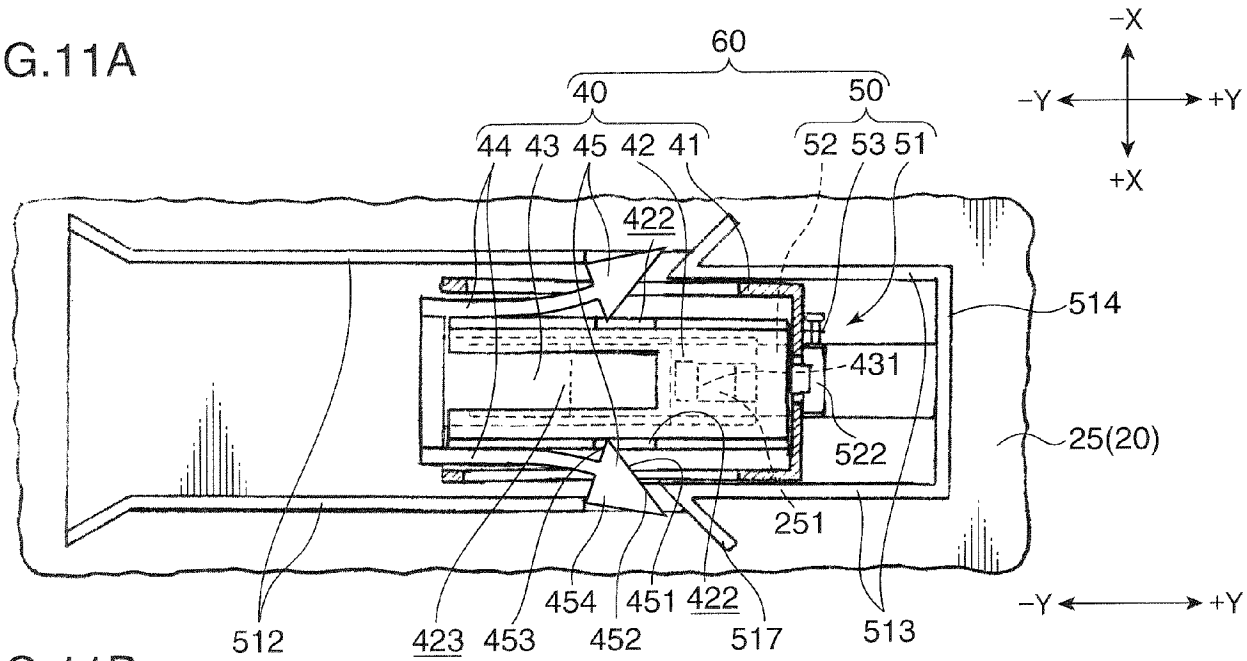
Figure 11B:
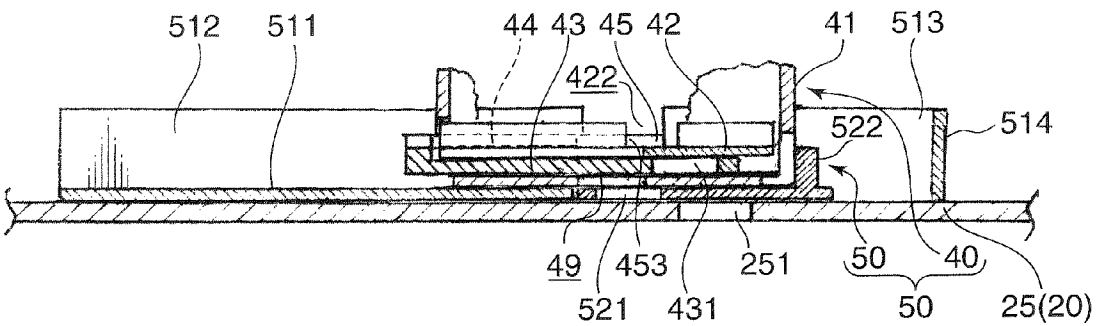
Figure 12A:
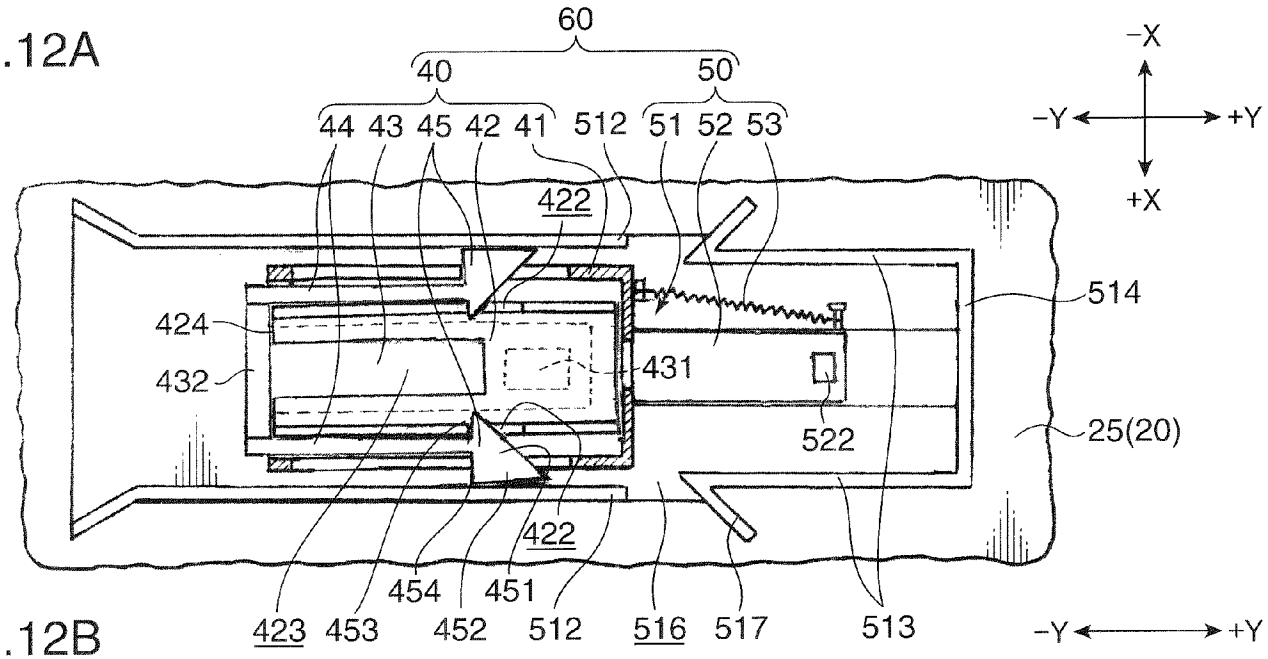
Figure 12B:
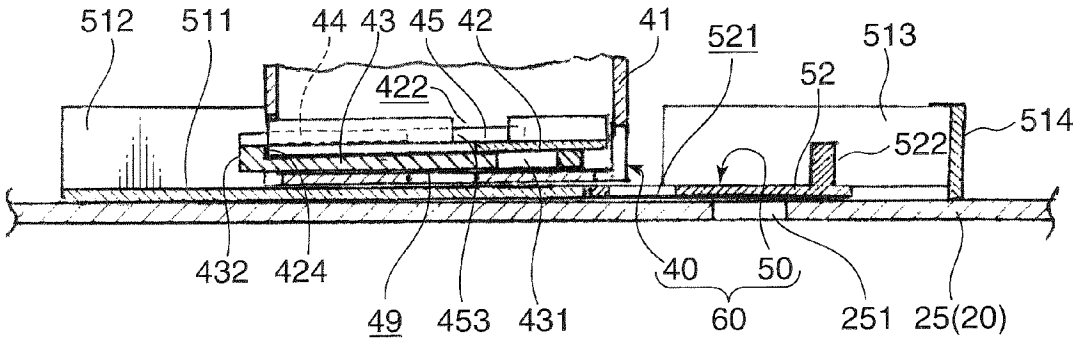

FIGS. 10A, 10B show a state where the shutter plate 43 is set to the opening position by mounting the gate member 40 into the guiding portion 50. FIGS. 11A, 11B show a state where the arrowhead members 45 are about to be disengaged from the guiding-portion side locking grooves 516 by starting to withdraw the gate member 40 from the guide member 51, and FIGS. 12A, 12B show a state where the gate member 40 is about to be withdrawn from the guiding portion 50.

In FIGS. 8A to 12B, the arrowhead members 45 are shown in an exaggerated manner as compared with the other members. The tubular body 48 shown in FIG. 5 is not shown in FIGS. 8A to 12B since graphical representation becomes, otherwise, complicated and difficult to see. Indication of directions by X and Y in FIGS. 8A to 12B is the same as in the case of FIGS. 2A and 2B (−X: leftward, +X: rightward, −Y: forward, +Y: backward).

Upon attaching the toner container 30 to the developing device 20, the gate member 40 is fitted into the guiding portion 50 formed on the lower top plate 25 of the developing device 20 with the rear end thereof in the lead as shown in FIGS. 8A, 8B. Then, the gate member 40 is pushed toward the back side (rear side) of the guiding portion 50 while the respective edge surfaces of the pair of arrowhead members 45 facing outward are held in sliding contact with the corresponding inner surfaces of the pair of wider guide walls 512.

At this time, the shutter board 52 is biased forward by the biasing force of the coil spring 53. Thus, the shutter board 52 is located in front in the shutter-plate mount groove 515 to close the toner receiving opening 251 of the developing device 20.

When it is continued to push the gate member 40 toward the back side (rear side) of the guiding portion 50, the box-shaped case 41 of the gate member 40 is introduced from the space between the pair of wider guide walls 512 to the space between the pair of narrower guide walls 513.

At this time, the forked plate 42 integral to the box-shaped case 41 also moves backward by being guided by the guiding portion 50. At this time, the inner locking claws 453 of the respective arrowhead members 45 provided at the leading ends (rear ends) of the pair of elastic arms 44 integral to the shutter plate 43 are engaged with the corresponding container side locking grooves 422 formed in the pair of edge ribs 421 of the forked plate 42. Accordingly, the shutter plate 43 moves together with the forked plate 42 until the respective arrowhead members 45 reach the pair of left and right guiding-portion side locking grooves 516 formed between the wider guide walls 512 and the narrower guide walls 513.

When the arrowhead members 45 reach the guiding-portion side locking grooves 516, the base ends 517A of the guide wings 517 interfere with the pointed portions 452 of the arrowhead members 45. Thus, if it is continued to push the box-shaped case 41, the hypotenuse edges 451 of the arrowhead members 45 are guided along the guide wings 517 and the respective elastic arms 44 are resiliently deformed in directions opposite to each other.

If it is continued to push the box-shaped case 41 into the guiding portion 50 in this state, elastic deformation amounts of the elastic arms 44 increase and, consequently, the inner locking claws 453 of the respective arrowhead members 45 are disengaged from the container side locking grooves 422. As a result, the forked plate 42 is pushed to the back side (rear side) between the narrower guide walls 513 while leaving the shutter plate 43. This causes the cutout opening 423 of the forked plate 42 to approach the toner receiving opening 251 formed in the lower top plate 25 of the developing device 20.

At this time, the cutout opening 423 approaches the toner receiving opening 251 until the passage hole 431 formed in the rear end of the shutter plate 43 overlaps with the toner receiving opening 251. Further, since the rear edge of the forked plate 42 pushes the pushable projecting piece 522 of the shutter board 52 backward against the biasing force of the coil spring 53 at this time, the shutter board 52 moves backward. This causes the passage hole 521 formed in the shutter board 52 to approach the toner receiving opening 251.

When the box-shaped case 41 is pushed to the back part of the guiding portion 50, i.e. the toner container 30 is attached to the developing device 20, the passage hole 521 of the shutter board 52, the toner replenishment opening 49 of the box-shaped case 41, the passage hole 431 of the shutter plate 43 and the cutout opening 423 of the forked plate 42 successively overlap right above the toner receiving opening 251 formed in the lower top plate 25 of the developing device 20 as shown in FIGS. 10A and 10B. By driving the unillustrated agitating/conveying member provided in the container body 31 in this state, toner in the toner container 30 is supplied to the developing device 20 via the cutout opening 423, the passage hole 431, the toner replenishment opening 49 and the passage hole 521.

A position maintaining portion for maintaining a state where the box-shaped case 41 is located in the back part of the guiding portion 50 is provided at a suitable position of the box-shaped case 41. This position maintaining portion utilizes, for example, a frictional force or a specified locking structure and maintains the mounted state of the box-shaped case 41 to the guiding portion 50 with a force larger than the biasing force of the coil spring 53. Accordingly, the state of the box-shaped case 41 pushed to the back part of the guiding portion 50 is stably maintained by the position maintaining portion. Further, the box-shaped case 41 is pulled forward from the guiding portion 50 by pulling the toner container 30 forward with a force larger than the maintaining force of the position maintaining portion.

Unillustrated stoppers are provided near the respective guide wings 517. The respective arrowhead members 45 come into contact with the corresponding stoppers, thereby preventing excessive outward deformation of the arrowhead members 45 and restricting an excessive movement of the shutter plate 43.

Next, a case is described where the toner container 30 once attached to the developing device 20 is withdrawn from the developing device 20. First of all, in the state shown in FIGS. 10A, 10B, the outer locking claws 454 of the arrowhead members 45 come into contact with the rear end edges of the wider guide walls 512 (edge portions of the guiding-portion side locking grooves 516) even if the shutter plate 43 tries to move together with the forked plate 42. Thus, a forward movement of the shutter plate 43 is hindered. Accordingly, only the forked plate 42 moves forward, whereby the passage hole 521 of the shutter board 52 is closed by the forked plate 42.

When the box-shaped case 41 is withdrawn forward from the guiding portion 50, the passage hole 431 of the shutter plate 43 is closed by the forked plate 42 as shown in FIGS. 11A, 11B. Further, with the outer locking claws 454 held in contact with the rear end edges of the wider guide walls 512, the inner locking claws 453 of the arrowhead members 45 are fitted into the container side locking grooves 422 of the forked plate 42.

Thereafter, as shown in FIGS. 12A, 12B, the deformed and curved elastic arms 44 return to their initial straight states due to elastic forces thereof, whereby the arrowhead members 45 are disengaged from the guiding-portion side locking grooves 516. This makes it possible that the shutter plate 43 moves together with the forked plate 42 (the box-shaped case 41). In this state, the toner receiving opening 251 of the developing device 20 is closed by the shutter board 52 and the toner replenishment opening 49 of the toner container 30 is closed by the shutter plate 43. Accordingly, with the toner container 30 detached from the developing device 20, the entrance of external matters into the developing device 20 via the toner receiving opening 251 can be effectively prevented and the leakage of toner in the toner container 30 via the toner replenishment opening 49 can also be prevented.

When the toner container 30 is detached from the developing device 20, the inner locking claws 453 of the arrowhead members 45 are fitted into the container side locking grooves 422 of the forked plate 42. Thus, the shutter plate 43 cannot move forward and, even if the user erroneously tries to move the shutter plate 43 backward, it cannot be done since the supporting block 432 of the shutter plate 43 is held in contact with a front edge portion 424 (see FIG. 12A) of the forked plate 42. In other words, the shutter plate 43 can move neither forward nor backward with respect to the container body 31 when the toner container 30 is about to be detached from the developing device 20 with the toner replenishment opening 49 of the toner container 30 closed and after the toner container 30 is detached. Therefore, the occurrence of such an inconvenience that the toner replenishment opening 49 is opened to leak and scatter the toner can be prevented.

As described above, in order to replenish the developing device 20 provided in the apparatus body 11 of the image forming apparatus 10 with toner, the toner container 30 according to this embodiment is detachably attached to the developing device 20 while being guided by the guiding portion 50 formed on the developing device 20. This toner container 30 includes the container body 31 formed with the toner replenishment opening 49 in the bottom plate 411 of the box-shaped case 41 and adapted to contain toner, the shutter plate 43 for opening and closing the toner replenishment opening 49 and the opening/closing structure 60 for causing the shutter plate 43 to perform the opening and closing operations as the container body 31 is mounted into and detached from the apparatus body 11.

This opening/closing structure 60 includes the elastic arms 44 projecting from the shutter plate 43 in the mounting direction of the container body 31 into the apparatus body 11, the arrowhead members 45 attached to the leading ends of the elastic arms 44, the guiding-portion side locking grooves 516 formed in the guiding portion 50 in correspondence with the arrowhead members 45 and the container side locking grooves 422 formed in the container body 31, wherein the arrowhead members 45 include the outer locking claws 454 engageable with and disengageable from the guiding-portion side locking grooves 516 and the inner locking claws 453 engageable with and disengageable from the container side locking grooves 422.

The inner locking claws 453 of the shutter plate 43 are fitted into the container side locking grooves 422, whereby forward and backward movements of the shutter plate 43 with respect to the container body 31 are hindered. Upon mounting the container body 31 into the apparatus body 11 along the guiding portion 50, the outer locking claws 454 are fitted into the guiding-portion side locking grooves 516 when the arrowhead members 45 reach the guiding-portion side locking grooves 516. At this time, the elastic arms 44 are elastically deformed and the inner locking claws 453 are disengaged from the container side locking grooves 422. On the other hand, upon withdrawing the container body 31, the outer locking claws 454 are disengaged from the guiding-portion side locking grooves 516. At this time, the elastically deformed elastic arms 44 are restored to the states before elastic deformation and the inner locking claws 453 are engaged with the container side locking grooves 422 again.

Accordingly, the toner replenishment opening 49 is not opened by a movement of the shutter plate 43 in a state where the toner container 30 is not mounted in the apparatus body 11. As the toner container 30 is mounted into the apparatus body 11 along the guiding portion 50, the elastic arms 44 are elastically deformed to disengage the inner locking claws 453 from the container side locking grooves 422, thereby hindering a movement of the shutter plate 43 together with the container body 31. By this operation, the toner replenishment opening 49 is opened.

Subsequently, as the container body 31 once mounted is withdrawn from the apparatus body 11, the inner locking claws 453 are engaged with the container side locking grooves 422 again as described above, wherefore the shutter plate 43 moves together with the container body 31 being withdrawn with the toner replenishment opening 49 closed. Thereafter, since the shutter plate 43 is made immovable with respect to the container body 31 by the inner locking claws 453, the shutter plate 43 cannot move in a state where the toner container 30 is being detached from the apparatus body 11.

In this embodiment, the arrowhead members 45 having an arrowhead shape are employed as the locking portions formed at the leading ends of the elastic arms 44. In such an arrowhead members 45, the outer locking claws 454 is formed at the outer corner portions of the base part of the arrowhead members 45 and the inner locking claws 453 is formed at the inner corner portions of the base parts thereof. By forming the locking portion by the triangular arrowhead member 45 in this way, the locking portion including the outer locking claws 454 and the inner locking claw 453 can have a simple structure, which contributes to a reduction in production cost.

Further, in this embodiment, the pair of elastic arms 44 are provided at the opposite sides in the width direction (lateral direction) orthogonal to the mounting direction of the shutter plate 43. Thus, upon being opened and closed, the shutter plate 43 can receive the same frictional force at the left and right sides due to the pair of elastic arms 44, i.e. forces act on the shutter plate 43 in a well-balanced manner, wherefore the shutter plate 43 can be stably opened and closed.

The guiding portion 50 is provided on the lower top plate 25 of the developing device 20. Thus, a replenishment path of toner from the toner container 30 to the developing device 20 can be set to be shortest and toner can be properly and quickly replenished into the developing device 20.

The present invention is not limited to the above embodiment thereof and, for example, also embraces the following contents.

(1) In the above embodiment, the printer is taken as an example of the image forming apparatus 10. The image forming apparatus is not limited to the printer and may be a copier or a facsimile machine.

(2) Although the shutter plate 43 is provided with the pair of left and right elastic arms 44 and the pair of left and right arrowhead members 45 in the above embodiment, the elastic arm 44 and the arrowhead member 45 may be provided either one of the left and right sides of the shutter plate 43.

(3) In the above embodiment, the front end edge 424 of the forked plate 42 is held in contact with the supporting block 432 of the shutter plate 43, thereby making it impossible to move the shutter plate 43 backward and to prevent the toner replenishment opening 49 from being opened by the movement of the shutter plate 43. However, depending on the vertical positional relationship, the three-dimensional shapes and the like of the forked plate 42 and the shutter plate 43, there can be cases where the front end edge 424 of the forked plate 42 and the supporting block 432 cannot be brought into contact with each other.

Even in such cases, the inner locking claws 453 of the arrowhead members 45 are fitted in the container side locking grooves 422 formed in the edge ribs 421 of the forked plate 42 in this embodiment. Thus, when the shutter plate 43 is moved backward, the back edges (hypotenuse edges 451) of the inner locking claws 453 come into contact with the rear edges of the container side locking grooves 422. Therefore, the backward movement of the shutter plate 43 is prevented and the toner replenishment opening 49 is not opened.

(4) In the above embodiment, the toner container 30 is directly attached to and detached from the developing device 20. Depending on the type of the image forming apparatus 10, the image forming apparatus 10 may be possibly constructed such that the toner container 30 cannot be directly attached to and detached from the developing device 20. In such a case, a platform used to attach and detach the toner container 30 may be arranged at a suitable position in the apparatus body 11 of the image forming apparatus 10 and a connecting duct for conveying toner may be provided between this platform and the developing device. In this case, the platform functions as the lower top plate 25 of the developing device 22 in the above embodiment.

(5) Although the shutter plate 43 is placed below the lower surface of the forked plate 42 in the above embodiment, the shutter plate 43 may be placed on the upper surface of the forked plate 42 instead. By doing so, the forked plate 42 can function as the box-shaped case 41 and contribution can be made to reduce the number of parts since the box-shaped case 41 needs not be provided.

Figure 13:
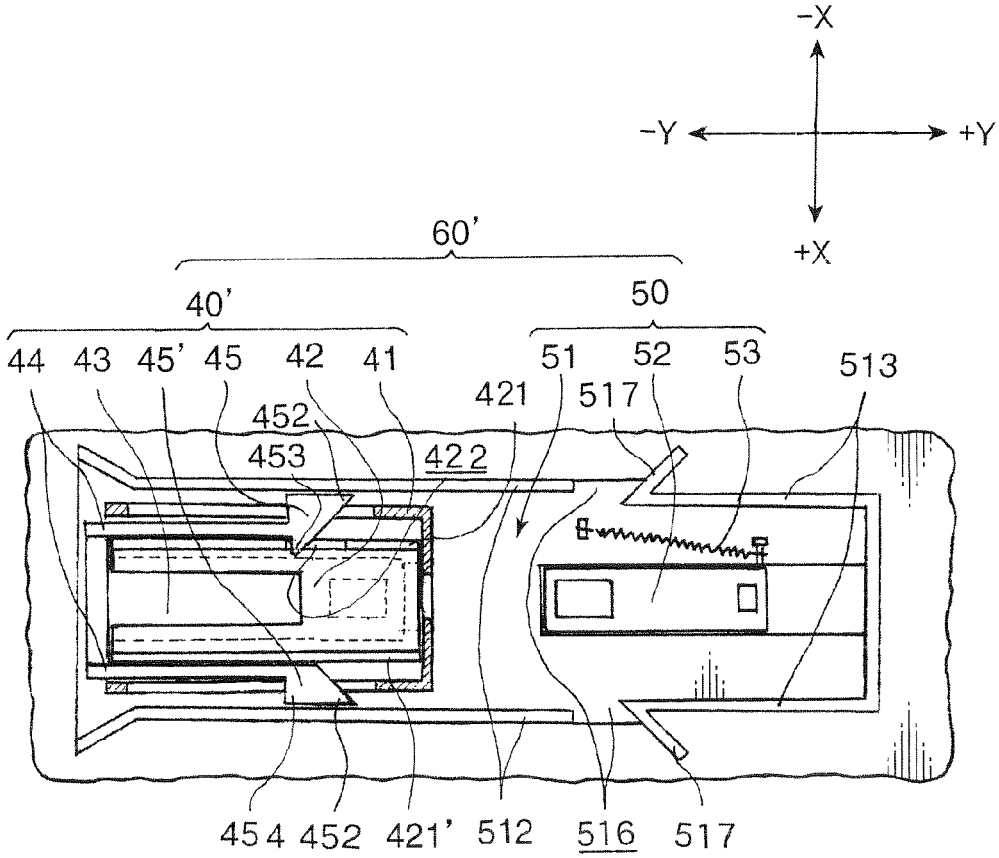
FIG. 13 is a plan view in section showing another embodiment of the opening/closing structure.

(6) FIG. 13 is a plan view in section showing an opening/closing structure 60' according to another embodiment. Indication of directions by X and Y in FIG. 13 is the same as in the case of FIGS. 2A and 2B (−X: leftward, +X: rightward, −Y: forward, +Y: backward). The opening/closing structure 60' of this embodiment includes a gate member 40' constructed to be slightly different from that of the previous embodiment and a guiding portion 50 similar to that of the previous embodiment.

In this embodiment, one of arrowhead members 45 (left arrowhead member 45 in an example shown in FIG. 13) as constituent elements of the gate member 40' includes an inner locking claw 453 similar to the above embodiment, but the other arrowhead member 45' (right arrowhead member in the example shown in FIG. 13) includes no inner locking claw 453. Thus, a container side locking groove 422, into which the inner locking claw 453 is fitted, is formed in one edge rib 421, whereas no container side locking groove 422 is formed in the other edge rib 421' because it is not necessary.

This arrangement is determined for the following reason. Specifically, pointed portions 452 of the left and right arrowhead members 45, 45' respectively interfere with left and right guide wings 517 when the box-shaped case 41 is pushed toward the back part of the guiding portion 50. Thereafter, the left and right arrowhead members 45, 45' are fitted into corresponding guiding-portion side locking grooves 516, thereby hindering a movement of a shutter plate 43 together with a forked plate 42. Upon hindering this movement, unless the same force acts on the shutter plate 43 at the left and right sides, the forked plate 42 loses lateral balance during its movement, thereby causing a problem that the box-shaped case 41 cannot smoothly move. Specifically, there may occur, for example, such a problem that the box-shaped case 41 moves while being laterally inclined and the back edge of the box-shaped case 41 collides with the front end of the guide wing 517. Thus, the left and right arrowhead members 45, 45' respectively include the pointed portions 452 in order to solve such a problem.

On the contrary, the inner locking claw 453 formed on the arrowhead member 45 is provided for the purpose of being fitted into a container side locking groove 422 of the forked plate 42 and moving the shutter plate 43 toward the back part (rear part) of the guiding portion 50 together with the forked plate 42 only while the left and right arrowhead members 45, 45' are located between a pair of wider guide walls 512 of the guiding portion 50, i.e. while the toner container 30 is not attached to the developing device 20. Accordingly, the shutter plate 43 and the forked plate 42 can smoothly move together with no substantial load acting on the inner locking claw 453. Thus, the inner locking claw 453 is provided only on the one arrowhead member 45 and no inner locking claw 453 is provided on the other arrowhead member 453. This can contribute to reductions in material cost and processing cost while properly ensuring the functions of the opening/closing structure 60'.

According to the present invention described above, upon detaching a container body from the apparatus body of the image forming apparatus, the shutter moves together with the container body as long as the second locking claw is engaged with the second engageable portion. Thus, the shutter can properly open and close the toner replenishment opening. Further, in a state where the container body is detached from the apparatus body, a movement of the shutter with respect to the container body is hindered. Thus, the occurrence of such an inconvenience that the shutter is erroneously opened and the toner inside is leaked to contaminate a surrounding environment can be effectively prevented. Furthermore, the locking portion includes the first locking claw engageable with and disengageable from the first engageable portion and the second locking claw engageable with and disengageable from the second engageable portion. Therefore, as compared with the case where the first and second locking claws are provided at the leading ends of different arms, the number of parts can be reduced, which can, in turn, contribute to a reduction of apparatus cost.

This application is based on Japanese Patent Application Serial Nos. 2008-335042 and 2009-269560, filed in Japan Patent Office on Dec. 26, 2008 and Nov. 27, 2009 respectively, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A toner supplying device detachably mountable into an apparatus body of an image forming apparatus while being guided by a guiding portion formed in the apparatus body, comprising:

a container body formed with a toner replenishment opening and adapted to contain toner;

a shutter for opening and closing the toner replenishment opening; and an opening/closing structure for causing the shutter to perform opening and closing operations as the container body is mounted into and detached from the apparatus body;

wherein:

the opening/closing structure includes an arm projecting from the shutter in a mounting direction of the container body into the apparatus body and a locking portion provided at an end of the arm;

the locking portion includes a first locking claw projecting in a first lateral direction with respect to an axis of the arm along the mounting direction, the first locking claw being engageable with and disengageable from a first engageable portion for locking formed at the guiding portion and a second locking claw projecting in a second lateral direction opposite the first lateral direction with respect to the axis of the arm along the mounting direction, the second locking claw being engageable with and disengageable from a second engageable portion for locking formed at the container body.

2. A toner supplying device according to claim 1, wherein:

a leading-end interfering portion for interfering with the first engageable portion is formed before the first and second locking claws in the mounting direction.

3. A toner supplying device according to claim 1, wherein:

the locking portion is formed by a triangular arrowhead member having a pointed leading end in a plan view;

the first locking claw is formed at an outer corner portion of a base part of the arrowhead member; and the second locking claw is formed at an inner corner portion of the base part.

4. A toner supplying device according to claim 3, wherein:

the locking portion includes a hypotenuse edge extending from the leading end toward the second locking claw; and the hypotenuse edge interferes with the first engageable portion to elastically deform the arm.

5. A toner supplying device according to claim 1, wherein a pair of arms are provided at opposite sides of the shutter in a width direction orthogonal to the mounting direction.

6. An image forming apparatus, comprising:

an apparatus body;

an image bearing member provided in the apparatus body for bearing an electrostatic latent image;

a developing device provided in the apparatus body for developing the electrostatic latent image formed on the image bearing member into a toner image;

a toner supplying device detachably mountable into the apparatus body for supplying toner to the developing device; and a guiding portion formed in the apparatus body for guiding a mounting movement of the toner supplying device into the apparatus body, wherein:

the toner supplying device includes:

a container body formed with a toner replenishment opening and adapted to contain toner;

a shutter for opening and closing the toner replenishment opening; and an opening/closing structure for causing the shutter to perform opening and closing operations as the container body is mounted into and detached from the apparatus body;

wherein:

the opening/closing structure includes an arm projecting from the shutter in a mounting direction of the container body into the apparatus body and a locking portion provided at an end of the arm; and the locking portion includes a first locking claw projecting in a first lateral direction with respect to an axis of the arm along the mounting direction, the first locking claw being engageable with and disengageable from a first engageable portion for locking formed at the guiding portion of the apparatus body and a second locking claw projecting in a second lateral direction opposite the first lateral direction with respect to the axis of the arm along the mounting direction, the second locking claw being engageable with and disengageable from a second engageable portion for locking formed at the container body.

7. An image forming apparatus according to claim 6, wherein the locking portion and the arm realize the following functions:

forward and backward movements of the shutter with respect to the container body are hindered by the engagement of the second locking claw with the second engageable portion;

the second locking claw is disengaged from the second engageable portion by an elastic deformation of the arm caused by the engagement of the first locking claw with the first engageable portion when the locking portion reaches the first engageable portion upon mounting the container body into the apparatus body along the guiding portion; and the second locking claw is engaged with the second engageable portion again by a restoring movement of the elastically deformed arm when the first locking portion is disengaged from the first engageable portion upon withdrawing the container body from the apparatus body along the guiding portion.

8. An image forming apparatus according to claim 7, wherein:

a leading-end interfering portion for interfering with the first engageable portion is formed before the first and second locking claws in the mounting direction.

9. An image forming apparatus according to claim 6, wherein:

the locking portion is formed by a triangular arrowhead member having a pointed leading end in a plan view;

the first locking claw is formed at an outer corner portion of a base part of the arrowhead member; and the second locking claw is formed at an inner corner portion of the base part.

10. An image forming apparatus according to claim 9, wherein:

the locking portion includes a hypotenuse edge extending from the leading end toward the corner portion with the second locking claw; and the hypotenuse edge interferes with the first engageable portion to elastically deform the arm.

11. An image forming apparatus according to claim 10, wherein:

the first engageable portion includes an inclined portion, with which the hypotenuse edge comes into contact when the container body is mounted into the apparatus body along the guiding portion; and the inclined portion guides the locking portion in a direction to disengage the second locking claw of the locking portion from the second engageable portion.

12. An image forming apparatus according to claim 11, wherein:

the guiding portion includes a guide portion in which a pair of wider guide walls and a pair of narrower guide walls having a narrower spacing than the pair of wider guide walls are arranged while being spaced apart in the mounting direction of the container body;

the first engageable portion is formed between the wider guide walls and the narrower guide walls; and the inclined portion is formed with an end edge of the narrower guide wall facing the wider guide wall as a base end.

13. An image forming apparatus according to claim 6, wherein:

a pair of arms are provided at opposite sides of the shutter in a width direction orthogonal to the mounting direction; and a pair of first engageable portions are provided in correspondence with these arms.

14. An image forming apparatus according to claim 6, wherein:

the guiding portion includes a guide portion in which a pair of wider guide walls and a pair of narrower guide walls having a narrower spacing than the pair of wider guide walls are arranged while being spaced apart in the mounting direction of the container body;

the first engageable portion is formed between the wider guide walls and the narrower guide walls.

15. A toner supplying device detachably mountable into an apparatus body of an image forming apparatus while being guided by a guiding portion formed in the apparatus body, comprising:

a container body formed with a toner replenishment opening and adapted to contain toner;

a shutter for opening and closing the toner replenishment opening; and an opening/closing structure for causing the shutter to perform opening and closing operations as the container body is mounted into and detached from the apparatus body, the opening/closing structure including an arm projecting from the shutter in a mounting direction of the container body into the apparatus body and a locking portion attached to the arm, the locking portion including a first locking claw engageable with and disengageable from a first engageable portion for locking formed at the guiding portion and a second locking claw engageable with and disengageable from a second engageable portion for locking formed at the container body, wherein the locking portion and the arm realize the following functions:

forward and backward movements of the shutter with respect to the container body are hindered by the engagement of the second locking claw with the second engageable portion;

the second locking claw is disengaged from the second engageable portion by an elastic deformation of the arm caused by the engagement of the first locking claw with the first engageable portion when the locking portion reaches the first engageable portion upon mounting the container body into the apparatus body along the guiding portion; and the second locking claw is engaged with the second engageable portion again by a restoring movement of the elastically deformed arm when the first locking portion is disengaged from the first engageable portion upon withdrawing the container body from the apparatus body along the guiding portion.

* * * * *